US011141841B2

(12) United States Patent
Amash et al.

(10) Patent No.: US 11,141,841 B2
(45) **Date of Patent: *Oct. 12, 2021**

(54) CONVERTIBLE FLEX RATCHET

(71) Applicant: Tekton, Inc., Grand Rapids, MI (US)

(72) Inventors: John A. Amash, Grand Rapids, MI (US); Joshua L. Harrison, Grand Rapids, MI (US); Kramer A. Doyle, Saugatuck, MI (US)

(73) Assignee: TEKTON, INC., Grand Rapids, MI (US)

( * ) Notice: Subject to any disclaimer, the term of this patent is extended or adjusted under 35 U.S.C. 154(b) by 217 days.

This patent is subject to a terminal disclaimer.

(21) Appl. No.: 16/292,967

(22) Filed: Mar. 5, 2019

(65) Prior Publication Data

US 2020/0282531 A1 Sep. 10, 2020

(51) Int. Cl.
*B25B 23/00* (2006.01)
*B25B 13/48* (2006.01)
*B25B 13/46* (2006.01)

(52) U.S. Cl.
CPC ..... *B25B 23/0028* (2013.01); *B25B 13/461* (2013.01); *B25B 13/481* (2013.01); *B25B 23/0035* (2013.01)

(58) Field of Classification Search
None
See application file for complete search history.

(56) References Cited

U.S. PATENT DOCUMENTS

| | | | | |
|---|---|---|---|---|
| 5,542,322 | A | 8/1996 | Knox et al. | |
| 7,066,059 | B1 * | 6/2006 | Hsieh | B25B 13/08 81/177.6 |
| 8,408,099 | B2 * | 4/2013 | Liou | B25G 1/063 81/177.8 |
| D786,639 | S * | 5/2017 | Yang | D8/27 |

OTHER PUBLICATIONS https://www.tekton.com/composite-ratchets, pp. 1-6, believed to be commercially available at least as early as Mar. 4, 2019.
https://www.tekton.com/flex-ratchets, pp. 1-10, believed to be commercially available at least as early as Mar. 4, 2019.
Pictures of ratchet believed to be commercially available at least as early as Mar. 4, 2019.

* cited by examiner

*Primary Examiner* — Hadi Shakeri
(74) *Attorney, Agent, or Firm* — Warner Norcross + Judd LLP

(57) ABSTRACT

A folding flex ratchet having a handle that is joined to a ratchet head by an offset hinge that allows the handle to be selectively folded between an extended position for applying greater torque and a folded position in which the ratchet operates in spaces where access is minimal, somewhat like a palm ratchet. The ratchet head may include a generally L-shaped neck that provides an offset handle connection point that is offset in two directions from the ratchet head, both rearwardly and longitudinally. The handle, ratchet head and offset hinge are configured so that, when in the folded position, the handle is approximately centered over the ratchet head and the handle extends substantially parallel to the ratchet head.

16 Claims, 5 Drawing Sheets

CONVERTIBLE FLEX RATCHET

BACKGROUND OF THE INVENTION

The present invention relates to hand tools, and more particularly to ratcheting socket wrenches for driving fasteners.

Ratcheting socket wrenches (also known as "ratchets") are well-known hand tools commonly used to tighten and loosen fasteners, such as bolts, nuts, screws and other rotary fastening elements. A typical ratchet has a ratchet head that houses the ratchet mechanism and a handle that extends from the ratchet head to provide a lever for operating the ratchet head. In many cases, the ratchet mechanism includes a standardized drive that is capable of receiving interchangeable drive components, such as various sockets configured to engage fasteners of different sizes and shapes. In most conventional applications, the ratchet drive is a square drive with a standard drive size, such as ¼", ⅜" ½", ¾" and 1". In typical applications, the handle of the ratchet extends a substantial distance from the ratchet head to provide a long lever for applying higher levels of torque. However, some ratchets do not include an extended handle. For example, a variety of palm ratchets have been developed for use in applications where less torque is required. A conventional palm ratchet includes a circular or palm shaped housing that is situated about the ratchet mechanism. In use, an individual can grip the housing in the palm of one hand to rotate the palm ratchet.

As a practical matter, fasteners can be disposed in locations that make it difficult to use a conventional straight-handle ratchet to rotate the head of the fastener. For example, in the context of an automobile, a fastener may be located in the engine compartment within a narrow opening that provides limited physical access to the head of the fastener. In some cases, the confines may be such that it is not possible to fit a conventional straight-handle ratchet onto the fastener. Even when it is possible to fit the ratchet onto the fastener, it may be difficult or impossible to move the ratchet handle through the range of motion needed to articulate the head of the fastener. To address this issue, a variety of ratchets with handles and ratchet heads of different shapes and sizes have been developed. For example, some conventional ratchets have a handle that extends at a fixed angle to the ratchet head. These types of ratchets are often referred to as "offset" ratchets. As another example, some conventional ratchets include a handle that is affixed to the ratchet head at a joint or hinge that allows the angle of the handle to vary with respect to the ratchet head, thereby allowing the position of the handle to be moved to the angle most convenient for use.

One specialized form of flex ratchet is designed to allow the ratchet head to fold inside an opening defined in the handle so that the flex ratchet can be used with an extended handle or with a folded handle. To facilitate this capability, the handle is somewhat oval shaped and broad, and defines an open interior space of appropriate size to receive the ratchet head. The hinge point is aligned with the longitudinal extent of the ratchet head and the handle. This ratchet configuration is bulky and oversized and has not been accepted commercially and does not currently appear to be available on the market. As a result, there remains a need for a more practical flex ratchet that is capable of folding into a compact shape suitable for use as a palm ratchet.

SUMMARY OF THE INVENTION

The present invention provides a flex ratchet in which the handle and ratchet head are joined by a hinge that is offset in a manner that allows the handle to be moved between an extended-handle position for applying greater torque and a folded position for providing a compact ratchet that is easily operated as a palm ratchet, typically with even better leverage and function than a conventional palm ratchet.

In one embodiment, the ratchet head includes a body that seats the ratchet mechanism and a neck that extends from the body. The neck may have a remote end that is pivotally joined to the handle at the hinge. In one embodiment, the neck is configured so that the hinge is offset rearwardly from the body of the ratchet head so that the handle is capable of folding over the ratchet head into a compact position in which the handle extends generally parallel to the rearward surface of the ratchet head. In one embodiment, the neck is somewhat L-shaped with a longitudinally extending segment and a rearwardly extending segment.

In one embodiment, the ratchet head and the handle each have a longitudinal extent and the hinge is configured so that the longitudinal extent of the ratchet head is offset from the longitudinal extent of the handle when the handle and ratchet head are oriented parallel to one another.

In one embodiment, the hinge includes a clevis and neck assembly. In one embodiment, the handle defines a clevis, and the neck of the ratchet head is fitted into and joined with the clevis by a pivot pin. The pivot pin extends through both legs of the clevis. The pivot pin may be secured to the clevis in any suitable manner, such as a friction fit, threaded fit and/or adhesive. In alternative embodiments, this configuration of the hinge may be reversed with the ratchet head including the clevis and the handle including the neck.

In an alternative embodiment, the offset may be incorporated into the handle rather than the ratchet head. In this embodiment, the handle includes an angled neck that extends at an angle to the general longitudinal extent of the handle. The neck is of appropriate length to allow the handle to fold generally flat against and parallel to the rearward surface of the ratchet head.

In one embodiment, the length of the ratchet head and the length of the handle are selected to optimize the balance of the ratchet. In one embodiment, the handle is no more than about 50% longer than the ratchet head. In another embodiment, the length of the handle is selected such that the ratchet drive is offset from the center of the length of the handle when in the folded position.

The present invention provides a simple and effective flex ratchet that not only provides the benefits of an extended-handle flex wrench, but also folds into a palm ratchet configuration for use when there is minimum access. The present invention provides an elegant solution that has evaded those who have attempted to provide similar functionality in the past. The unique offset hinge arrangement of the present invention allows the flex ratchet to operate effectively in both extended and folded configurations. When the handle is extended, the offset in the ratchet head positions the handle above (or away from) the head of the fastener, which can facilitate movement of the handle in many situations that involve limited access to the head of the fastener. The ratchet head, offset hinge and handle are configured to provide improved functionality in both the extended and folded positions. For example, the position and amount of offset in the ratchet head may be selected to correspond with the size (e.g., diameter) of the handle so that, when folded, the handle lies generally flat along and extends generally parallel to the ratchet head. Further, the handle length and hinge location may be selected so that, when the handle is folded, the ratchet drive is offset from the center of the length of the handle to provide a longer lever arm. These features help to improve the balance and operation of the ratchet when used as a palm ratchet.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and capable of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

A folding flex ratchet 10 in accordance with an embodiment of the present invention is shown in FIGS. 1-5. The flex ratchet 10 generally includes a ratchet head 12 and a handle 14 that are pivotally joined at a hinge 16. The hinge 16 allows the handle 14 to pivot with respect to the ratchet head 12. The hinge 16 is offset so that the handle 14 can be folded back onto the ratchet head 12 with the handle 14 extending generally parallel to the ratchet head 12 and with the folded handle 14 approximately centered over the ratchet head 12. When the handle 14 is in the extended position, it provides an extended lever for multiplying the force applied to the fastener. When the handle 14 is in the folded position, the ratchet 10 is in its most compact configuration for maximum access and functions much like a palm ratchet.

The present invention is described with reference to drawings of a folding flex ratchet suitable primarily for use with standard ¼", ⅜" and ½" square drives. The ratchet 10 is intended to interchangeably receive conventional sockets and other conventional drive components configured to interfit with the standardized ratchet drive. It should be noted, however, that the present invention may be readily adapted for use with ratchets of different sizes and with different types of drives. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

Figure 1:
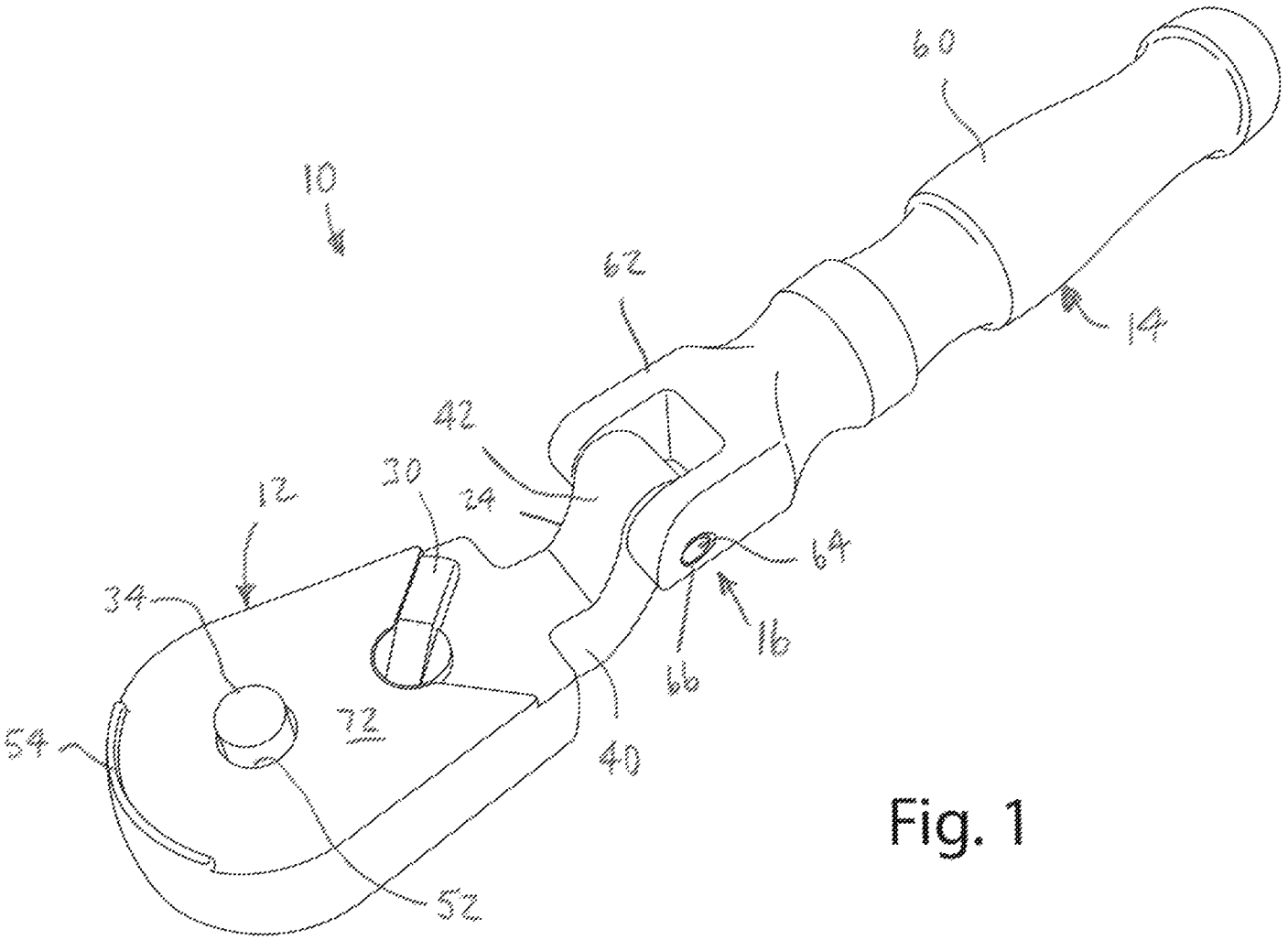
FIG. 1 is a first perspective view of a flex ratchet in accordance with an embodiment of the present invention.
Figure 2:
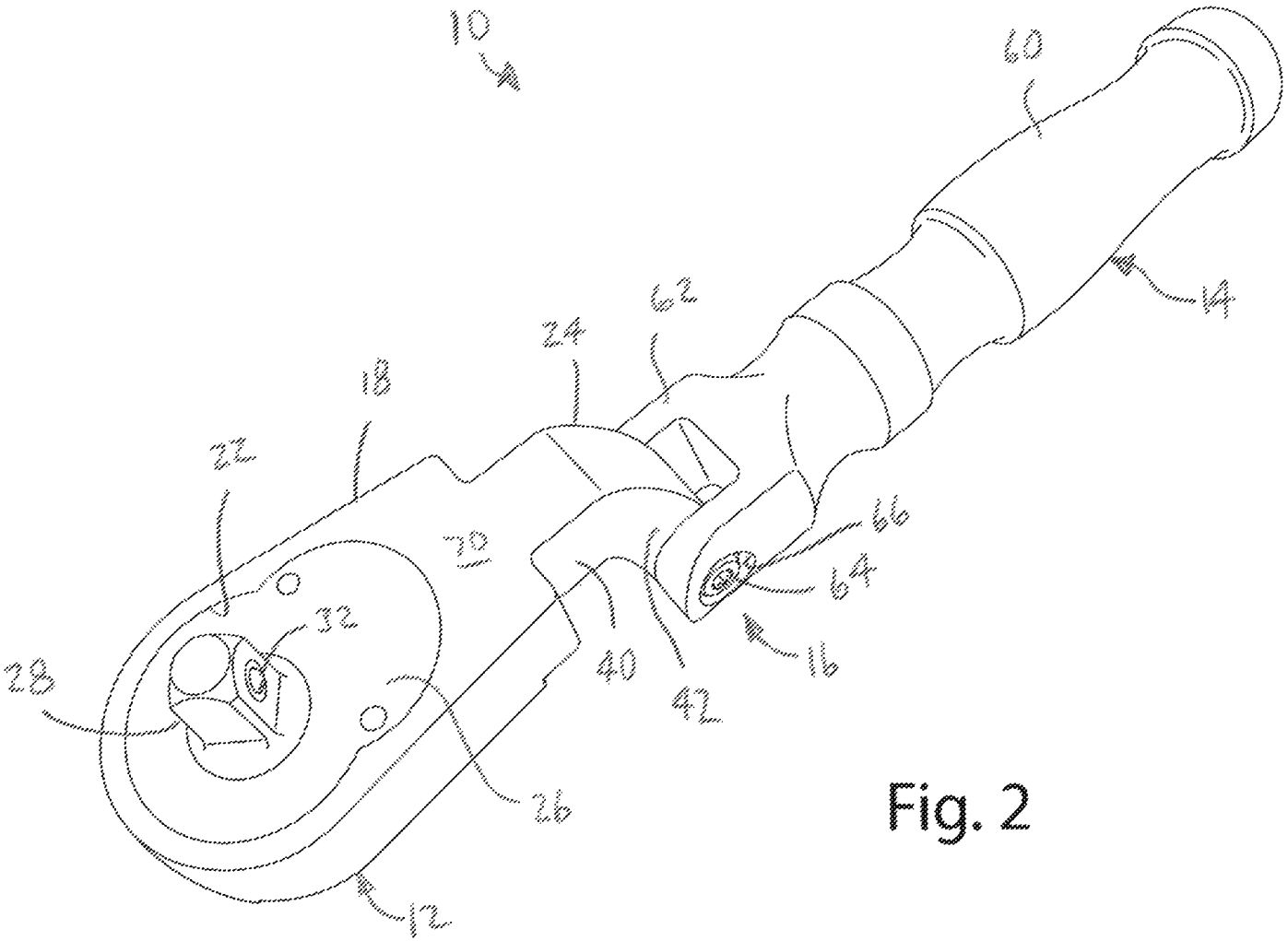
FIG. 2 is a second perspective view of the flex ratchet.
Figure 3:
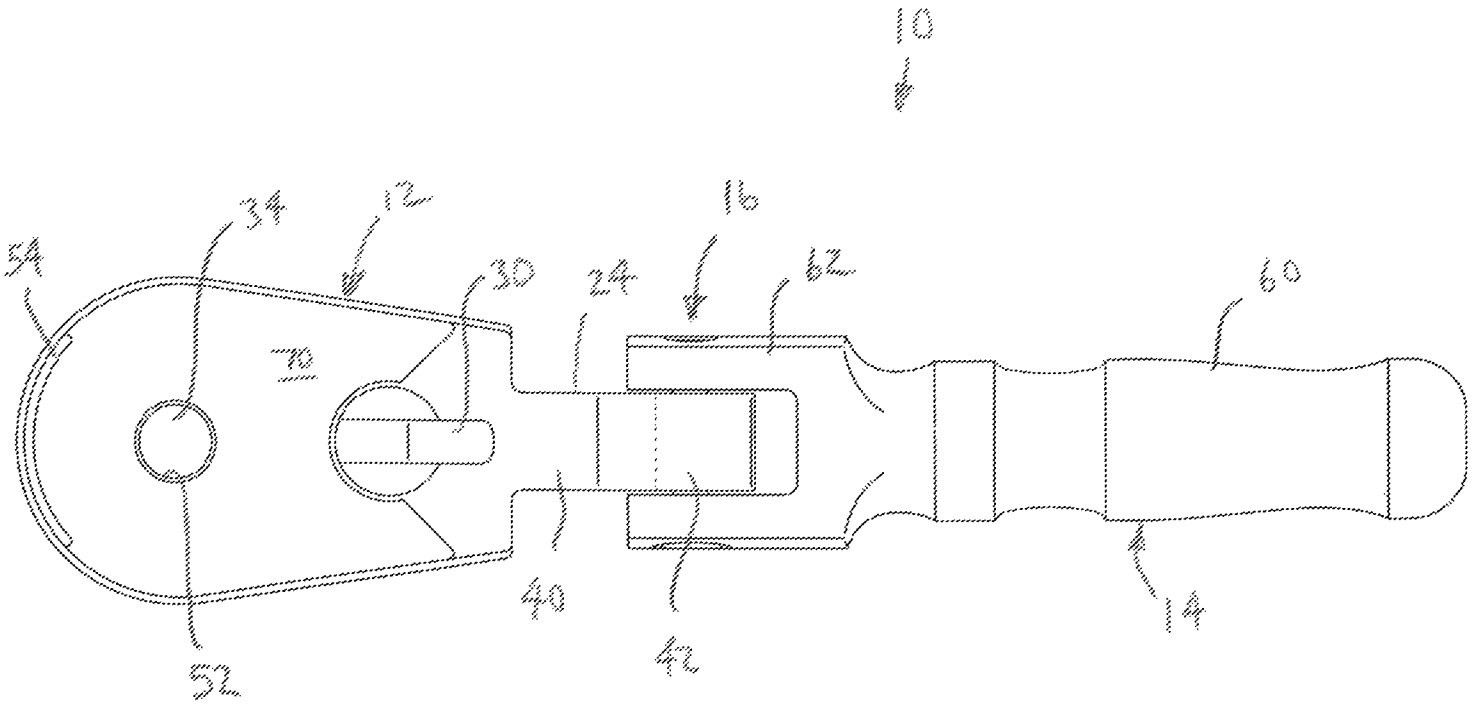
FIG. 3 is a top view of the flex ratchet.
Figure 4:
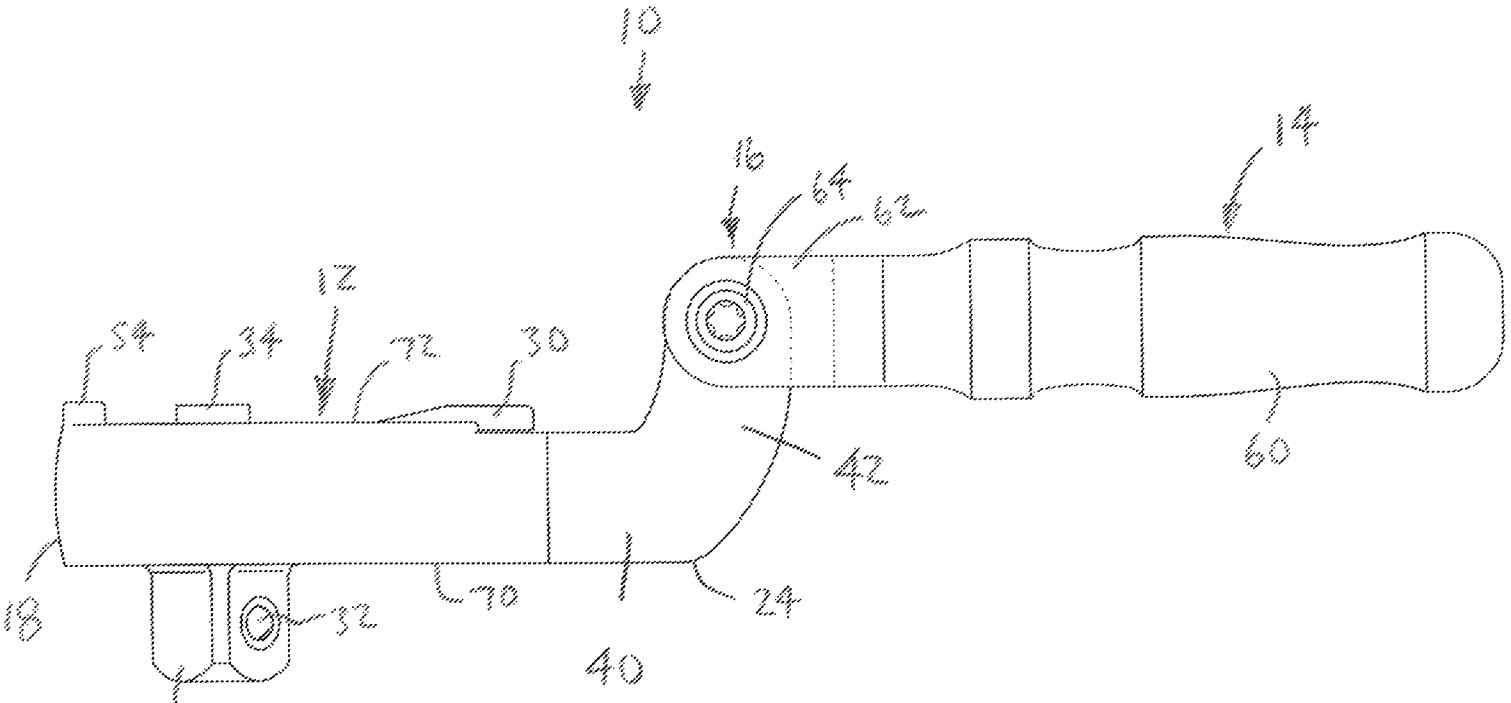
FIG. 4 is a side view of the flex ratchet with the handle extended.

As noted above, a ratchet 10 manufactured in accordance with the present invention is shown in FIG. 1. The ratchet 10 of FIG. 1 generally includes a ratchet head 12 and a handle 14. The ratchet head 12 and handle 14 are pivotally joined at a hinge 16. The hinge 16 allows the handle 14 to be pivoted into a position extending away from the ratchet head 12 to provide increased advantage for high torque applications, or to be folded onto the ratchet head 12 to shorten the ratchet 10 and allow it to be used essentially as a palm ratchet. The handle 14 may, in a manner similar to conventional flex ratchets, be pivoted into essentially any position between the extended position and the folded position as desired to facilitate rotation of a fastener. For example, the handle 14 may be oriented to avoid structures that might otherwise interfere with operation of the ratchet 10.

Figure 5:
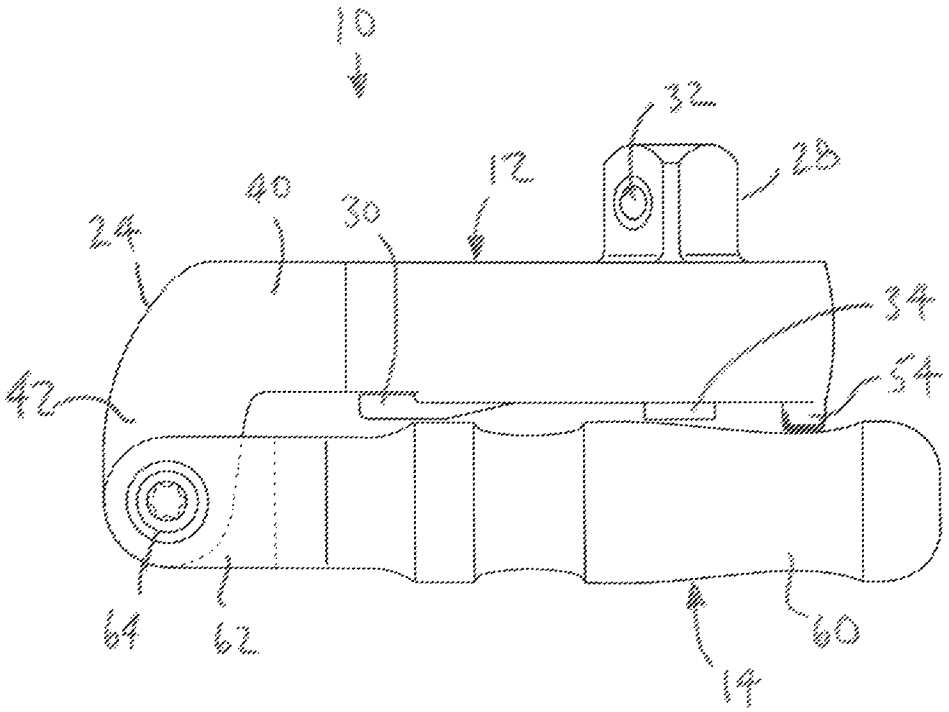
FIG. 5 is a side view of the flex ratchet with the handle folded.

The ratchet head 12 of the illustrated embodiment generally includes a body 18 and an extended neck 24. The body 18 has a forward surface 70 and a rearward surface 72, and defines a ratchet opening 22 configured to seat a ratchet mechanism 26. The ratchet mechanism 26 is fitted into the body 18 from the forward surface 70, but includes components that extend through and are accessible from the rearward surface 72. The ratchet mechanism 26 is secured in the body 18, for example, by a snap ring (not shown). In the illustrated embodiment, the ratchet mechanism 26 is a generally conventional ratchet mechanism 26 with a ratchet drive 28 that extends from the forward surface 70 of the ratchet head 12 and an internal mechanical arrangement that provides ratcheting operation of the ratchet drive 28. The illustrated ratchet drive 28 includes a conventional ¼" square drive configured to be selectively fitted with interchangeable drive components, such as sockets and other drive components. The present invention can, however, be readily incorporated into ratchets with drives of other sizes, shapes and types. For example, the ratchet 10 may include a square drive with essentially any standard drive size, such as ¼", ⅜" and ½". The illustrated ratchet mechanism 26 is selectively operable in a first mode in which the ratchet drive 28 is driven in a clockwise rotation and a second mode in which the ratchet drive 28 is driven in a counterclockwise rotation. The illustrated embodiment, the ratchet mechanism 26 includes a toggle switch 30 disposed on the rear surface of the ratchet head 12 where it is movable by the user to select clockwise or counterclockwise drive operation (See FIG. 1). In this embodiment, the body 18 defines a toggle switch opening through which the shaft (not shown) of the toggle switch 30 extends through the rear of the body 18. Additionally, the ratchet drive 28 of the illustrated embodiment includes a generally conventional locking arrangement that operates to secure sockets and other drive components on the ratchet drive 28. In this embodiment, the locking arrangement includes a ball bearing 32 that protrudes from the ratchet drive 28 to interlock with a corresponding recess, detent, or ledge on the interior of the socket or other elements. The ratchet mechanism 26 includes a release button 34 that protrudes from the rear of the ratchet head 12. When depressed, the release button 34 mechanically operates internal mechanisms that allow the ball bearing 32 to retract or move into the ratchet drive 28, thereby allowing a socket or other drive component to be mounted on or removed from the ratchet drive 28. In this embodiment, the body 18 defines a release button opening 52 through which the release button 34 extends through the rear of the body 18. The body 18 of the illustrated embodiment also includes a stop 54 that protrudes from the rear surface of the body 18 in a position in which it will be engaged by the handle 14 when the handle 14 is folded against the ratchet head 12. As shown in FIG. 5, the stop 54 has sufficient height to prevent the handle 14 from being folded into engagement with the release button 34. This prevents unintentional operation of the release button 34 during use of the folded ratchet 10. The illustrated ratchet mechanism 26 is merely exemplary and may be replaced by any of a wide range of alternative ratchet mechanisms. For example, in some alternative embodiments, the ratchet may include a ratchet mechanism that does not include a release button 34. In alternative embodiments of this nature, the ball bearing 32 may be eliminated or it may be spring-loaded to move under force without the need for a user to operate a release button. In embodiments that do not include a release button, the release button opening may be eliminated from the body of the ratchet head. In such embodiments, the rearward surface of body may be generally smooth, except for any openings or contours that might be provided to accommodate a toggle switch (or other type of switch) that controls the drive direction of the ratchet mechanism. Further, when there is no release button, the stop may be eliminated or may be revised to accommodate whatever structure might remain on the rearward surface of the ratchet.

As noted above, the ratchet head 12 includes an extended neck 24. In this embodiment, the neck 24 is configured to provide an offset mounting point for the handle 14. The offset is selected to allow the handle 14 to fold generally flat against the ratchet head 12 and to center the folded handle 14 roughly over the ratchet head 12. As perhaps best shown in FIG. 4, the neck 24 is somewhat L-shaped and includes a first segment 40 that extends from the body 18 in a direction parallel to the length of the ratchet head 12 and a second segment 42 that extends from the first segment 40 at an angle to the length of the ratchet head 12. The generally L-shaped configuration of the neck 24 allows the second segment 42 to approach the hinge 16 at an angle that does not interfere with pivoting movement of the handle 14 into the folded position. The angle of the second segment 42 may vary from application to application, but in the illustrated embodiment is between about seventy degrees to about eighty degrees or between about sixty degrees to about ninety degrees. In this embodiment, the second segment 42 follows a gradual curve. The size, shape and configuration of the neck 24, including the first segment 40 and the second segment 42 may vary in alternative embodiments. The remote end of the second segment 42 is pivotally joined to the handle 14 at the hinge 16. In the illustrated embodiment, the remote end of the second segment 42 defines a hinge pin opening (not shown) that is configured to connect the handle 14 as described in more detail below. In this embodiment, the first segment 42 and second segment 44 are configured to offset the hinge 16 in two directions. For example, the neck 24 is configured to offset the hinge 16 in a rearward direction a distance selected to cause the handle 14 to extend substantially parallel to the ratchet head 12 when folded against the ratchet head 12, and in the longitudinal direction a distance selected to approximately center the folded handle 14 over the ratchet head 12 (See FIG. 5). With regard to the rearward offset, the ratchet head 12 and the handle 14 of the illustrated embodiment are configured so that the hinge pin 64 is offset from the rear surface of the ratchet head 12 in a rearward direction by a distance approximately equal to ½ the diameter of the handle 14 at the point where the handle 12 engages the stop 54. In the illustrated embodiment, the diameter of the handle 14 varies along its length and the shape of the handle 14 is taken into consideration in selecting the rearward offset and the dimensions of the stop 54. With regard to the longitudinal offset, the ratchet head 12 and the handle 14 of the illustrated embodiment are configured so that the hinge pin 64 is offset a distance selected to approximately center the handle 14 over the ratchet head 12 when that handle 14 is in the folded configuration.

In the illustrated embodiment, the handle 14 includes an elongated shaft 60 with a clevis 62 at one end. In this embodiment, the shaft 60 is generally circular in cross-section and, as noted above, varies in cross-sectional diameter along its length. The clevis 62 is configured to form part of the hinge 16. In this embodiment, each leg of the clevis 62 defines a hinge pin opening 66. The hinge pin openings 66 extend laterally and are aligned with one another. More specifically, in this embodiment, the neck 24 is fitted into the clevis 62 and is joined with the clevis by a hinge pin 64. The hinge pin 64 extends through the hinge pin openings 66 in both legs of the clevis 62 and through the hinge pin opening 54 in the neck 24. The hinge pin 64 may be secured to the clevis 62 and/or the neck 24 in any suitable manner, such as a friction fit, interference fit, threaded fit and/or adhesive. For example, one or both of the hinge pin openings 66 in the clevis 62 may be internally threaded and the hinge pin 64 may be externally threaded so that the hinge pin 64 can be secured by a threaded engagement. In alternative embodiments, the configuration of the hinge 16 may be reversed with the ratchet head 12 including the clevis and the handle 14 including the neck. The clevis and neck arrangement of the illustrated embodiment is merely exemplary and the ratchet head 12 and handle 14 may be pivotally joined by alternative arrangements.

The relative sizes of the ratchet head 12 and the handle 14 may be selected to optimize the balance and function of the ratchet 10 in both the folded and extended positions. In the illustrated embodiment, the handle 14 is no more than about 20% longer than the ratchet head 12. For example, in the context of a ratchet 10 for a ¼" or ⅜" square drive, the ratchet head 12 may have an overall length of approximately 65 mm and the handle 14 may have an overall length of approximately 75 mm. Further, in the illustrated embodiment, the first segment 40 of the neck 24 has a length of approximately 10 mm and the second segment 42 has a length of approximately 15 mm. As a result, the hinge pin 64 of the illustrated embodiment is offset from the center of the ratchet drive 28 in a direction perpendicular to the length of the ratchet drive 28 by about 48 mm and is offset from the rear surface of the ratchet head 12 by about 10 mm. These dimensions are merely exemplary and the lengths of the ratchet head 12 and the handle 14 may vary from application to application. For example, referring again to ratchet 10 for a ¼" or ⅜" square drive, the ratchet head 12 may have a length between about 60 mm and about 90 mm, and the handle 14 may have a length between about 70 mm and about 100 mm. Further, the size of the ratchet head 12 and the handle 14 may be increased (e.g., scaled up) with ratchets having a larger drive size, such as ½" and ¾" square drives.

In the illustrated embodiment, the length of the handle 14 is selected such that the ratchet drive 28 is offset from the center of the ratchet 10 (e.g., offset from the center of the length of the handle) when the handle 14 is in the folded position. For example, the ratchet drive 28 may be offset from the center by approximately 15 mm (or in a range of about 12 mm to about 18 mm). Offsetting the ratchet drive 28 provides a longer lever arm and thereby facilitates the application of greater force even when the handle 14 is folded and the ratchet 10 is being used as a palm ratchet.

Although not shown, the ratchet may, in some alternative embodiments, include a locking hinge that allows the user to lock the angle of the handle with respect to the ratchet head. A variety of flex ratchets with locking hinges are commercially available and therefore the locking hinge will not be described in detail. Suffice it to say that, in one example, the neck may include a plurality of parallel grooves and the handle may include a locking tooth that can be selectively engaged or disengaged with the grooves. More specifically, the locking tooth may be engaged with one of the grooves to lock the handle at the desired angle or disengaged from the grooves to allow free movement of the handle relative to the ratchet head. In applications that include a locking hinge, the stop and/or offset may be adjusted to accommodate the locking structure, such as the locking tooth.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A ratchet comprising:

a ratchet head having a body and a neck extending from the body, the body having a front surface and a rear surface, the body defining an opening, the neck extending from the body to define a hinge point offset from the rear surface of the body, the body extending generally longitudinally and the neck including a rearward extending segment extending rearwardly beyond the rear surface, the rearward extending segment having a remote end distant from the rear surface, the neck terminating at the remote end of the rearward extending segment such that the body and the neck are collectively L-shaped, wherein the hinge point is located toward the remote end of the neck;

a ratchet mechanism seated within the opening in the body, the ratchet mechanism including a ratchet drive protruding from the front surface of the ratchet head, the ratchet drive configured to selectively engage with interchangeable sockets or other drive elements; and a handle pivotally joined to the ratchet head at the hinge point defined by the neck, wherein the handle defines a length that is not more than 20% greater than a length defined by the ratchet head, the hinge point being offset from the rear surface such that the handle is selectively movable between an extended position in which the handle extends from the ratchet head in a first position remote from and substantially parallel to the rear surface of the ratchet head and a folded position in which the handle is folded into a second position adjacent and substantially parallel to the rear surface of the ratchet head, the handle being movable between the extended position and the folded position by pivoting the handle relative to the neck about 180 degrees about the hinge point.

2. The ratchet of claim 1 wherein the handle has a general diameter and the hinge point is offset from the rear surface of the body by a distance equal to about ½ the general diameter of the handle.

3. The ratchet of claim 2 wherein the ratchet drive is a ¼" square drive or a ⅜" square drive, the ratchet head has a length between about 60 mm and about 90 mm, the handle has a length between about 70 mm and about 100 mm.

4. The ratchet of claim 2 wherein the ratchet mechanism has a release button protruding from the rear surface of the body, the body including a stop protruding from the rear surface, the stop configured to engage the handle when the handle is folded onto the ratchet head to prevent the handle from actuating the release button.

5. The ratchet of claim 4 wherein the neck includes a longitudinally extending segment extending from the body and wherein the rearward extending segment extends at an angle of sixty degrees to ninety degrees from the longitudinally extending segment.

6. The ratchet of claim 5 wherein the handle includes a clevis at one end, the clevis pivotally joined to the rearward extending segment of the neck by a hinge pin.

7. A folding, flex head ratchet comprising:

a ratchet head having a body with a forward surface and a rear surface, the body defining an opening, the ratchet head including an integral neck extending from the body, the body extending generally longitudinally and the neck including a longitudinally extending segment and a rearward extending segment, the longitudinally extending segment extending from the rearward extending segment, the rear extending segment having a remote end, the neck terminating at the remote end of the rearward extending segment such that the neck is L-shaped and the body and the neck are collectively L-shaped;

a ratchet mechanism seated within the opening and having a ratchet drive extending from the forward surface; and a handle pivotally secured to the neck at an offset hinge and being movable about the offset hinge at least about 180 degrees between an extended position and a folded position, the handle defining a length of not more than 20% greater than a length defined by the ratchet head, the offset hinge being located toward the remote end of the rearward extending segment of the neck and being offset from the rear surface in a rearward direction such that, when in the extended position, the handle extends remote from and substantially parallel with the general extent of the rear surface and, when in the folded position, the handle extends adjacent to and substantially parallel with the general extent of the rear surface.

8. The ratchet of claim 7 wherein the offset hinge is offset from the ratchet head in a longitudinal direction such that, when in the folded position, the handle is generally centered over the ratchet head.

9. The ratchet of claim 7 wherein the handle includes a clevis that is pivotally joined to the neck by a hinge pin.

10. The ratchet of claim 9 wherein the neck includes a longitudinally extending segment extending longitudinally from the body and wherein the rearward extending segment extends at an angle relative to the longitudinally extending segment.

11. The ratchet of claim 10 wherein the rearward extending segment extends at an angle of between about sixty degrees and about ninety degrees relative to the longitudinally extending segment.

12. The ratchet of claim 11 wherein the ratchet mechanism includes a rearwardly extended release button, the ratchet head including a stop extending rearwardly from the body, the stop configured to prevent the handle from actuating the release button when in the folded position.

13. A folding flex ratchet comprising:

a handle having a longitudinally extended shaft and a clevis extending from one end of the shaft;

a ratchet head having a body with a forward surface and a rearward surface, the body receiving a ratchet mechanism having a ratchet drive extending forwardly beyond the forward surface, the ratchet head extending generally longitudinally and including a neck integral with and extending from the body, the neck including a rearward extending segment having a remote end with the neck terminating at the remote end of the rearward extending segment such that the body and the neck are collectively L-shaped, the neck defining an offset connection point located toward the remote end of the rearward extending segment of the neck at which the clevis is pivotally connected to the neck, the connection point being offset in a rearward direction such that the handle can be pivoted about the neck at the connection point between an extended position in which the handle is remote from and extends substantially parallel with the general extent of the rearward surface, and a folded position in which the handle extends adjacent to and substantially parallel with the general extent of the rearward surface, the connection point being offset in a longitudinal direction such that the handle is approximately centered over the ratchet head when in the folded position;

wherein the handle defines a length that is not more than 20% greater than a length defined by the ratchet head.

14. The ratchet of claim 13 wherein the shaft has a diameter and the connection point is offset from the rear surface of the body in a rearward direction a distance slightly greater than about ½ the diameter of the shaft.

15. The ratchet of claim 13 wherein the ratchet drive is longitudinally offset from the longitudinal center of the ratchet head.

16. The ratchet of claim 15 wherein the neck includes a longitudinally extending segment extending longitudinally from the body and wherein the rearward extending segment extends at an angle of sixty degrees to ninety degrees relative to the longitudinally extending segment.

* * * * *